US005671331A

United States Patent [19]

Croley

[11] Patent Number: 5,671,331

[45] Date of Patent: Sep. 23, 1997

[54] PRINTED PUBLICATION VENDING APPARATUS INCLUDING PROGRAMMABLE ANNOUNCEMENT CAPABILITY

[76] Inventor: Harold G. Croley, 12651 Holly La., DeWitt, Mich. 48820

[21] Appl. No.: 328,795

[22] Filed: Oct. 31, 1994

[51] Int. Cl.[6] ..... G10L 3/00

[52] U.S. Cl. ..... 395/2.79; 395/2.1; 395/2.81; 221/3; 369/69

[58] Field of Search ..... 221/152, 28; 40/312, 40/661, 455; 52/143; 369/30, 32, 69; 340/521; 355/206, 209; 200/5 A; 134/57 D; 395/2.83, 2.81, 2.79, 2.1

[56] References Cited

U.S. PATENT DOCUMENTS

| | | | |
|---|---|---|---|
| 1,876,424 | 9/1932 | Kenyon | 221/3 |
| 1,912,226 | 5/1933 | Sepin et al. | 194/312 |
| 3,176,815 | 4/1965 | Farinola | 194/244 |
| 3,609,250 | 9/1971 | Morris | 369/32 |
| 4,375,329 | 3/1983 | Park | 355/209 |
| 4,500,971 | 2/1985 | Futaki et al. | 395/2.83 |
| 4,509,543 | 4/1985 | Livingston et al. | 134/57 D |
| 4,554,419 | 11/1985 | King et al. | 200/5 A |
| 4,572,652 | 2/1986 | Tada et al. | 355/206 |
| 4,765,074 | 8/1988 | Loos | 40/661 |
| 4,821,027 | 4/1989 | Mallory et al. | 340/521 |
| 4,876,532 | 10/1989 | Sauls | 340/689 |
| 4,940,160 | 7/1990 | Williams | 221/34 |
| 4,954,697 | 9/1990 | Kokubun et al. | 235/381 |
| 5,045,327 | 9/1991 | Tarlow et al. | 395/2.79 |
| 5,097,981 | 3/1992 | Degasperi et al. | 221/3 |
| 5,117,407 | 5/1992 | Vogel | 369/30 |
| 5,226,266 | 7/1993 | Cernuto | 52/143 |
| 5,301,831 | 4/1994 | Holmes | 221/28 |
| 5,313,725 | 5/1994 | DeVassie | 40/312 |
| 5,318,195 | 6/1994 | Kahanek et al. | 221/152 |

*Primary Examiner*—Krista M. Zele
*Assistant Examiner*—Scott Wolinsky
*Attorney, Agent, or Firm*—Gifford, Krass, Groh, Sprinkle, Patmore, Anderson & Citkowski

[57] ABSTRACT

A vending apparatus for printed publications includes a programmable announcement capability which permits audio messages to be played in response to a customer stimulus. Programming is conveniently carried out through the connection of a portable programming unit to the vending apparatus to download a message stored in the programming unit. Such programming may be done frequently, such as daily, or at such time when the rack is refilled with printed publications. The announcement capability within the vending apparatus is preferably triggered when a customer opens an access panel on the rack, which then plays the message downloaded through the portable programming unit.

13 Claims, 4 Drawing Sheets

PRINTED PUBLICATION VENDING APPARATUS INCLUDING PROGRAMMABLE ANNOUNCEMENT CAPABILITY

BACKGROUND

1. Field of Invention

This invention relates generally to vending machines of the type which include an announcement capability and, in particular, to such apparatus wherein a portable programming device is utilized to update the announcement on an occasional basis.

2. Background of the Invention

Originally, single copies of newspapers were sold on street comers by "news boys," young boys who stood on sidewalks and promoted their newspapers by announcing, for example, the names of the newspapers they sold and the titles of headline stories. This image of the street-corner news boy is now a familiar part of American culture. Yet, for better or worse, newspaper companies have replaced the news boy with a mechanical, coin-operated newspaper sales rack (or "newsrack"). The advantages of these mechanical replacements are obvious: they can "stand" on street comers for twenty-four hours every day, they require no supervision, they are less vulnerable to crime and inclement weather, and they require no remuneration.

The substitution of news boys for mechanical newspaper sales racks also came with certain costs, however. Most notably, makers of newspaper sales racks, and therefore newspaper companies themselves, have found no substitution for the news boy's lost voice. Existing newspaper sales racks cannot talk. Consequently, they afford newspaper companies no opportunity to promote their products by, for example, encouraging passers-by to purchase a newspaper, apprising potential customers of the day's headline story, mentioning retail sales advertisements found within the day's newspaper, and thanking customers for buying a newspaper—all tasks the news boy could perform. Sales from newspaper sales racks thus are made only to customers who happen to pass by, or who happen themselves to notice the day's headline, or who themselves decide to buy a newspaper in order to find out whether area merchants are having any sales.

Hoping to use newspaper sales rocks to promote as well as dispense newspapers, some newspaper companies began putting placards on their sales racks. Typically, these page-sized placards slide into the front face of the base of a sales rack. See, e.g., U.S. Pat. No. 4,940,160 (Williams 1990). Simple variations not relevant here exist. See, e.g., U.S. Pat. No. 4,765,074 (Loos 1988) (improvement on basic placard design); U.S. Pat. No. 5,313,725 (DeVassie 1994) (three-sided placard holder). They contain simple messages, explaining, for example, the time at which papers will be available each day or, for another example, the fact that the papers contained within the sales rack report daily sports scores.

The very nature of these placards limits their success. First, their message is visual, not audible. As they cannot be heard by potential customers, they cannot make up for the lost audible element of street-corner newspaper sales. Second, they are vulnerable to bad weather. They can be covered up by snow and damaged by rain. Third, they can contain only very brief messages. This is true owing to an unavoidable trade-off between the length of a placard message, on one hand, and the extent to which the message can be read, on the other hand. Placards can be only as wide as a newsrack itself, and thus longer messages must be in smaller script too difficult to see from a distance, while messages in script that can be seen at a distance must necessarily be very short and simple.

These disadvantages do not exhaust the limitations of placards. Newspaper sales rack placards are disadvantageous also because they require complete replacement every time a new message is desired. Although they can be recycled, old placards are not otherwise reusable. This means that a newspaper company must make a new fixed investment in new placards each and every time a new message is desired. As a result, placards, where they are used at all, are seldom replaced. They serve as little more than a means for identifying which newspaper is sold from a given newspaper sales rack. For all of these reasons, newspaper sales racks, given the state of prior art, largely dispense newspapers. Existing newsracks do little to sell or promote newspapers and the contents of newspapers.

Existing newspaper sales racks aside, the only prior art that provides audio capabilities for vending machines is designed specifically for jukeboxes and other types of vending machines, and is not suitable to the unique characteristics of newsracks and the newsrack sales market. U.S. Pat. No. 3,609,250 (Morris 1971) provides an apparatus for playing audio messages to vending machine customers, prior to the selection of particular merchandise, for the purpose of affecting customer choice of which particular piece of merchandise from a vending machine to select. This prior art utilizes tape cartridges and a timing circuit to play audio messages. This technology is expensive and cumbersome, and tape cartridges require regular maintenance. U.S. Pat. No. 5,117,407 (Vogel 1992) also provides audio and as well as video apparatus for helping customers select from a number of products, this especially suited for jukeboxes. This prior art uses a video synthesizer and a device to display video signals in response to coordinated audial messages. It involves intricate and costly technology not simple, durable, or cost-effective enough for newspaper sales racks. What is more, it too provides for fixed messages aimed to guide consumer selection from among a set of products in a jukebox or other vending machine.

None of this prior art provides any way to reprogram audio messages frequently and at low cost. This is not surprising: most vending machines offer a choice among a fixed set of products, each one of which is unchanging from day to day. Newsracks, in contrast, offer a single product, a newspaper, the exact contents of which do change daily. Thus, prior vending machine art, even were it simple, durable, and economical enough for adaptation to newsracks, is not useful for newspaper sales racks.

In sum, prior newsrack art provides no means for producing audial messages, and prior vending machine art capable of producing audial messages is not well suited to the newsrack sales market, which, unlike most vending machine markets, involves the sale of a single product the exact form of which changes every day. The newspaper sales rack market thus lacks a simple, durable, and cost-efficient technology for programming and, more importantly, frequently reprogramming audial messages to correspond to each new day's newspaper.

SUMMARY OF THE INVENTION

This invention has several objects and advantages that overcome the above-described limitations of existing newspaper sales racks and other vending machine technology. In most general terms, it will equip newspaper sales racks with the ability to produce audial messages, thereby adding sound to the experience of purchasing a newspaper from a rack, and it will equip newspaper sales rack operators with a quick, easy, and low-cost way of programming and reprogramming such messages. The particular objects and advantages of the talking newspaper sales rack are:

(a) to provide a fast, low cost means of equipping newspaper sales racks with the ability to play programmed audial messages;

(b) to provide a fast and low-cost means of re-programming newspaper sales racks' programmed audial message daily, to correspond with the contents of each day's newspaper, without any investment in new materials;

(c) to equip newspaper sales racks with the ability to play cyclical or rotating audial messages;

(d) to equip newspaper sales racks with the ability to play long messages, not limited by the inherent constraints of physical space;

(e) to equip newspaper sales racks with the ability to play messages the communication of which is not dependent upon fair weather;

(f) to equip newspaper sales racks with the ability to play programmed audial messages and thereby to provide newspaper companies a new opportunity to promote their newspapers by thanking customers for buying a newspaper;

(g) to equip newspaper sales racks to play programmed audial messages and thereby to provide newspaper companies a new opportunity to promote their newspapers by apprising potential customers of headline stories;

(h) to equip newspaper sales racks to play programmed audial messages and thereby to provide newspaper companies with a new opportunity to promote their newspapers by apprising potential customers of the existence of stories not visible on the front page of the day's newspaper;

(i) to equip newspaper sales racks to play programmed audial messages and thereby to provide newspapers companies a new opportunity to attract potential customers away from competitor newspapers;

(j) to equip newspaper sales racks to play programmed audial messages and thereby to provide newspapers companies a new opportunity to promote their newspapers by apprising potential customers of sales by retail merchants who advertise in newspapers; and (k) to equip newspaper sales racks to play programmed audial messages and thereby to provide newspaper companies with a new retail advertising technology which they can offer to their retail advertising client.

These objects and advantages will become clear from a consideration of the application's ensuing drawings and description.

Overall, this invention improves upon existing newspaper sales racks first by providing a device for playing programmed audial messages to customers and/or potential customers. It further improves upon existing newsracks by providing a device for reprogramming messages as often as every time the newsrack is refilled with newspapers. This invention also includes a triggering device for activating the programmed message(s) in response to stimuli by customers or potential customers. These improvements are specially designed and suited for conventional newspaper sales racks and to the needs of the newspaper rack sales market.

DETAILED DESCRIPTION OF THE PREFERRED EMBODIMENTS

Existing newspaper sales racks are simple mechanical devices. They consist of only a few basic parts: a body to house the newspapers, a base which supports the body, a door which is opened by customers to retrieve a newspaper, and a coin mechanism to regulate the amount of money needed to disengage the door thereby allowing customers to open the door and retrieve a newspaper. Innovations unrelated to the present invention have been added to this basic structure, see, e.g., U.S. Pat. No. 5,226,266 (Cernuto 1993) (wheels added to basic news rack); U.S. Pat. No. 5,301,831 (Holmes 1994) (basic newspaper rack with improved dispensing assembly); U.S. Pat. No. 5,318,195 (Kahanek 1994) (anti-theft device for basic news rack), but the essential parts of a newspaper sales rack are these.

Figure 1:
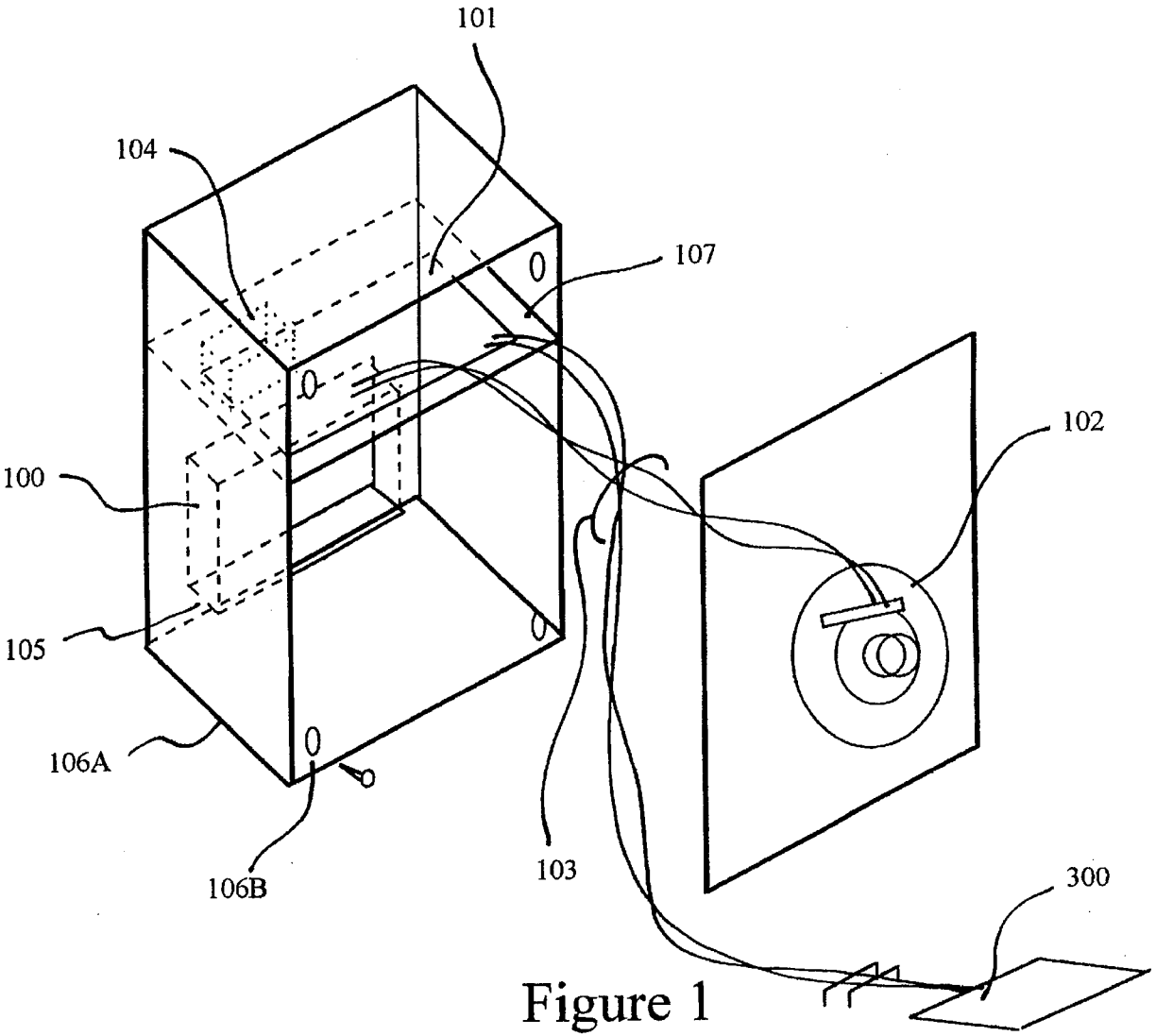
FIG. 1 is an oblique-view illustration of a newsrack speaker unit according to the invention.

The talking newspaper sales rack improves upon the basic newsrack first by adding a recording and replaying device shown in FIG. 1, the "Newsrack Speaker Unit." This device consists, in the preferred embodiment, of a battery power source (100), programmable computer voice chip (101), circuit board (107), female electronic phone jack (104), casing material (105), protective housing box (106A) with mounting screws (106B), which houses the aforesaid battery, voice chip, and phone jack, connecting wire (103), and large weatherproof audio speaker (102).

The battery is connected to and supplies power to the programmed voice chip. The voice chip is connected to the electronic phone jack, used for programming audio messages, as well as to the audio speaker, used for playing programmed messages.

Figure 2:
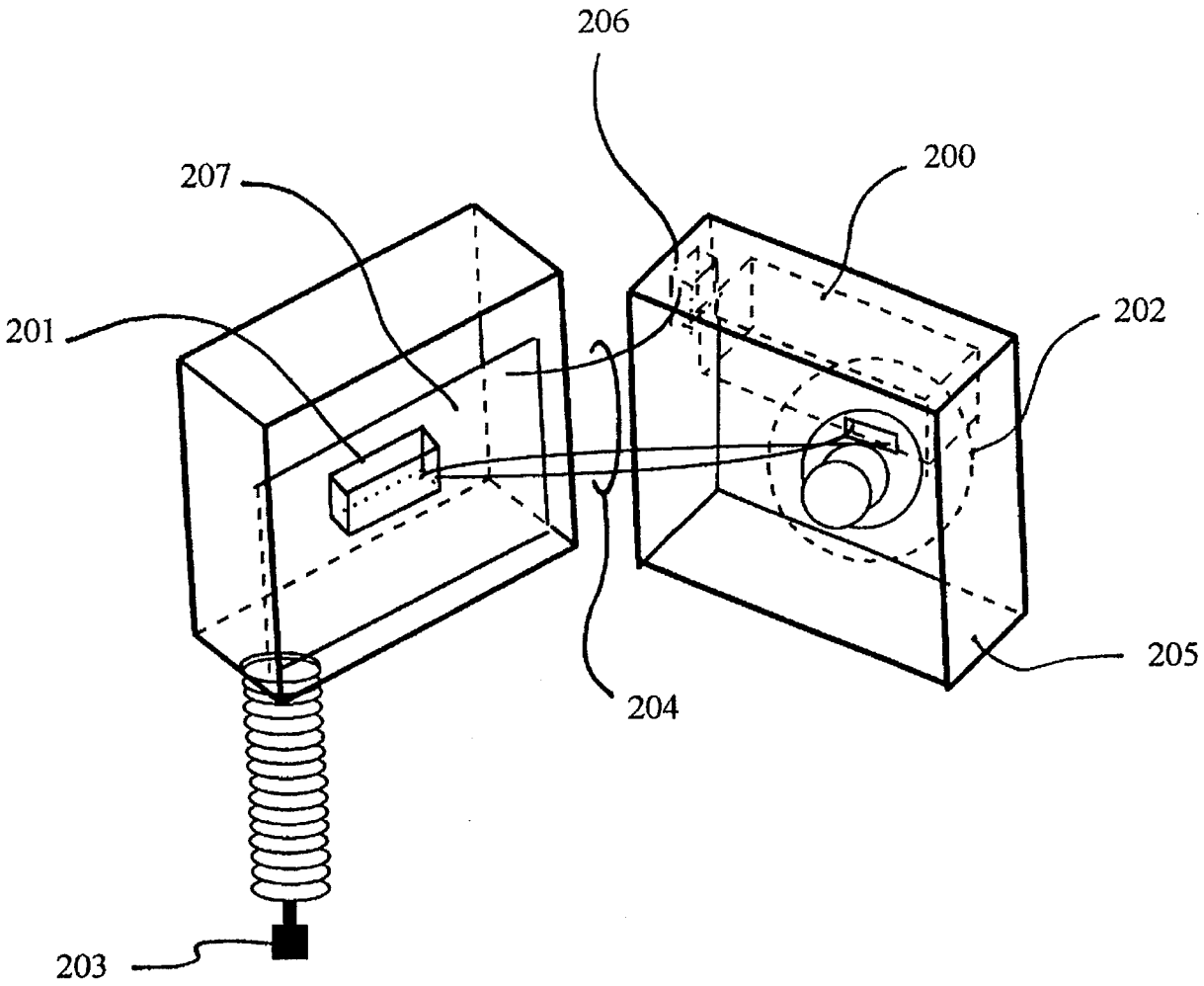
FIG. 2 is an oblique drawing of a portable programming unit according to the invention.

A programming device, the small "Portable Programming Unit," shown in FIG. 2, is used to program the Newsrack Speaker Unit. In the preferred embodiment, the Portable Programming Unit consists of its own battery (200), computer voice chip (201), circuit board (207), crystal (208), small audio speaker (202), connecting wire (204), and unit casing material (205), male electronic phone jack (203), and on-off switch (206).

Here too, the battery is connected to and supplies power to the voice chip, which is connected by the connecting wire to the audio speaker 202 and to the male phone jack 203. The unit casing material houses all of the other parts of the Portable Programming Unit. The Portable Programming Unit is external to and not part of the improved newsrack. Rather, as explained below (see "Operation," below), it is to be carried by owners and operators of improved newsracks and used for programming messages into the Newsrack Speaker Unit. Programming the Newsrack Speaker Unit is accomplished by attaching the Portable Programming Unit's male electronic phone jack to the Newsrack Speaker Unit's female electronic phone jack.

Figure 3:
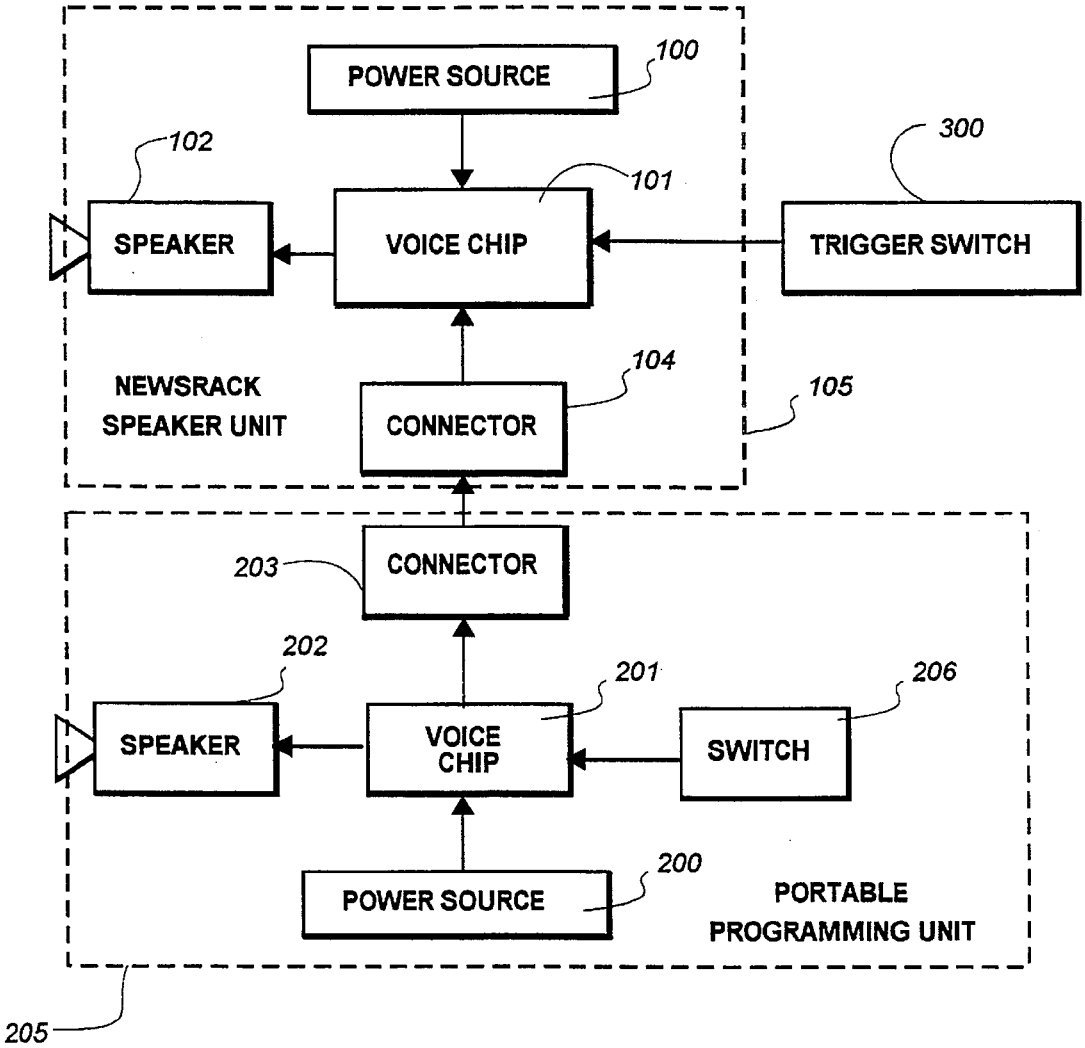
FIG. 3 is a block diagram which shows major functional units associated with the newsrack speaker unit and portable programming unit.

FIG. 3 provides a block diagram of the major functional units associated with both the newsrack speaker unit and portable programming unit. A triggering switch 300, the "Newsrack Speaker Unit Activating Device," depicted in FIGS. 3 and 4, activates the programmed Newsrack Speaker Unit. In preferred form, it consists of a two-piece magnetic field switch (300A & 300B) (other types of triggering switches will be mentioned below), double faced adhesive tape (301), and connecting wire (302). The double-faced adhesive tape holds half of the magnetic switch to the door latch, and the other half of the magnetic switch to the body of the newsrack. The connecting wire runs from the magnetic switch to the Newrack Speaker Unit's voice chip.

Figure 4:
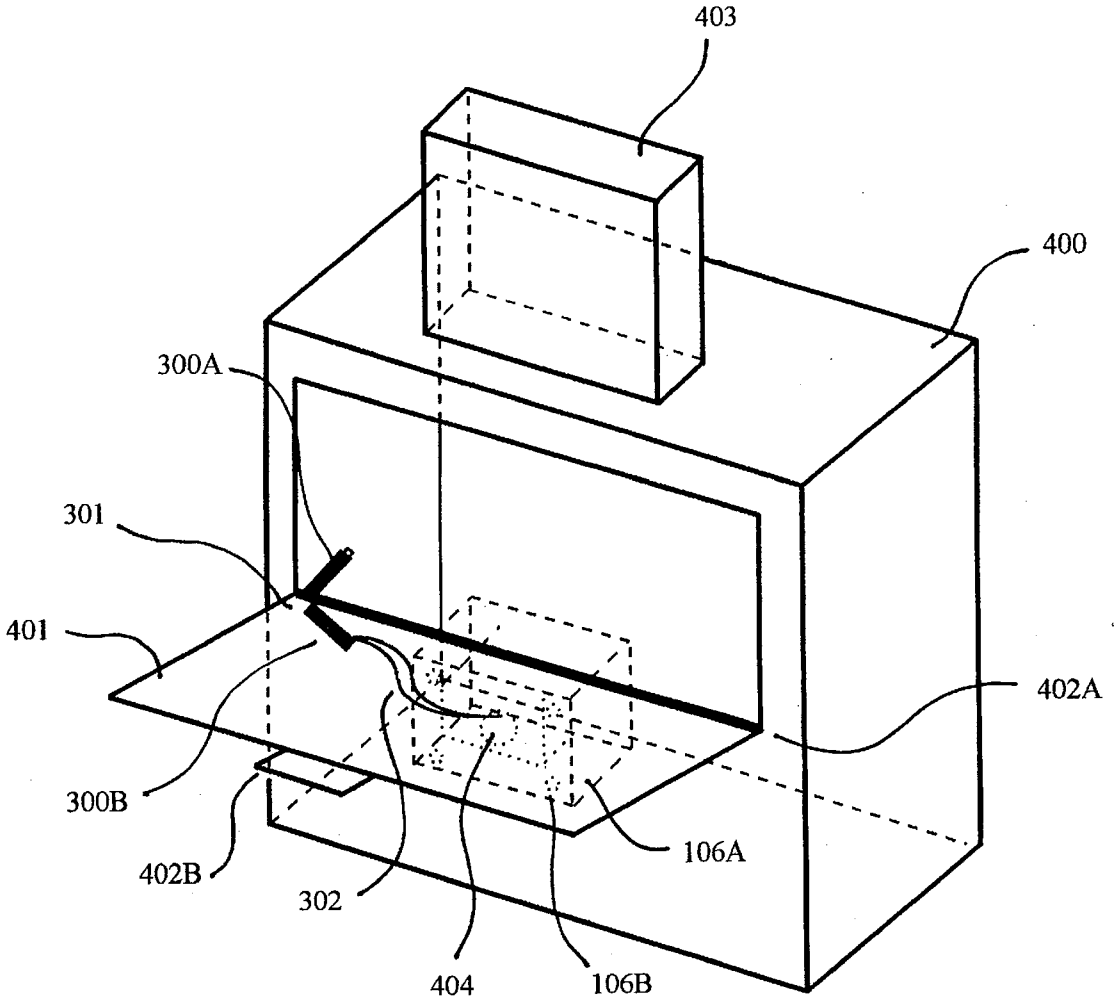
FIG. 4 is an oblique-view which depicts a newsrack speaker unit according to the invention having been mounted within a conventional newspaper-type vending apparatus.

These improvements are put into full context in FIG. 4, "Newsrack Speaker Unit Programmed and Mounted in Actual Newsrack." FIG. 4 shows the Newsrack Speaker Unit mounted in a typical newspaper sales rack, consisting of a rack body (400), door (401) with hinges and stop-latch (402A & 402B, respectively), and rack head with coin mechanism (403). FIG. 4 further shows the Newsrack Speaker Unit Activating Device mounted on a rack door latch and rack body of the newsrack, and connected to the Newsrack Speaker Unit. As can be seen in FIG. 4, the Newsrack Speaker Unit's large weather-proof audio speaker is protected by a speaker grid (404) which is, with the Speaker Unit itself, mounted inside the body and near the base of the newsrack.

Operation. The Talking Newspaper Sales Rack operates as follows. When a customer places money in the improved newsrack's coin mechanism and opens the door to purchase a newspaper, the movement of the newsrack door will cause half of the Newsrack Speaker Unit Activating Device's magnetic switch to pass by its other half. The movement of the two parts of the polarized switch past each other will send a current through connecting wire to the Newsrack Speaker Unit's voice chip. In turn, the voice chip will send a programmed message to the Newsrack Speaker Unit's audio speaker. The speaker will play a programmed message, instantaneously as the newsrack door is opened.

The Newsrack Speaker Unit is programmed/reprogrammed with the use of Portable Programming Unit. A person operating the Portable Programming Unit simply plugs that unit into the Newsrack Speaker Unit, and records a spoken message. The person operating the Portable Programming Unit can "test" the message by playing it back through the Portable Programming Unit's own audio speaker. If not satisfied with the message as recorded, the operator can re-record a message. Once satisfied with the message, the operator can program the Newsrack Speaker Unit's voice chip with the new message. Reprogramming the Newsrack Speaker Unit requires only a moment's time.

What is more, the newsrack operator can change the message daily (or more frequently), every time the sales rack is filled with newspapers. Thus, one programmed message may announce to customers buying a newspaper that "Store X is having a clearance sale today; details on page B10." The very next day, the newsrack's message may say instead: "Newspapers are available for home delivery at our new price of $Y/week." The next day, the message may say: "President introduces budget to Congress; see page A2."

Although the above description and drawings contain many specificities, they should not be construed as limiting the scope of the invention, but rather as merely providing illustrations of some of the presently preferred embodiments of this invention. First, all aspects of this invention may take different specific sizes and dimensions. Similarly, most component parts of this invention may be made of materials other than those mentioned herein.

Second, the protective housing box containing the battery, voice chip, and phone jack of the Newsrack Speaker Unit, may be mounted into the body of a newsrack, or shown, or it may be held in place by detachable clips, thus allowing for easier access for repair and battery replacement.

Furthermore, while the programmed speaker unit, the portable programming unit, and the speaker fixture are core parts of this invention, the programmed voice chip may be triggered in ways other than the opening of the newspaper sales rack door. For one example, it could be triggered by a simple infra-red eye sensor that activates the Newsrack Speaker Unit whenever someone passes close by a sales rack. Alternatively, the programmed message may play at regular intervals without being triggered by movement of the newspaper rack door or by nearby motion.

Thus, the scope of the invention should be determined not by the embodiments illustrated, but by the appended claims and their legal equivalents.

What is claimed is:

1. A system for vending printed publications including a programmable announcement capability, the system comprising:

an enclosure dimensioned to house a plurality of printed publications, including an access panel through which a customer may obtain one or more of the publications;

a trigger switch;

speaker unit, including:

an input to receive an announcement in electronic form, an audio speaker, and a voice circuit in electrical communication with the trigger switch, the input, and the audio speaker, the voice circuit being operative to perform the following functions:

receive and store the announcement in electronic form, retrieve the stored announcement upon activation of the trigger switch, and deliver an electrical signal representative of the announcement to the audio speaker so that the announcement may be heard by the customer; and a portable programming unit, including:

means for storing one or more announcements in electronic form, an output adapted for electrical coupling to the input of the speaker unit, and an operator control, whereby an announcement stored within the portable programming unit may be downloaded into the speaker unit upon activation of the operator control.

2. The system of claim 1, wherein the printed publications are newspapers.

3. The system of claim 1, wherein the trigger switch is mechanically coupled to the access panel.

4. The system of claim 1, further including:

sensing means for detecting when a person is physically proximate to the enclosure, and wherein the trigger switch delivers an activation signal to the speaker unit in response thereto.

5. The system of claim 1, wherein the speaker unit is further operative to:

deliver an electrical signal representative of the announcement to the audio speaker on an occasional basis without the trigger switch being activated.

6. The system of claim 1, wherein the portable programming unit further includes:

a speaker; and electrical circuitry for audibly reviewing a stored announcement in response to an operator control prior to the downloading of the announcement into the speaker unit.

7. The system of claim 1, further including:

electrical circuitry associated with the portable programming unit and speaker unit for audibly reviewing an announcement stored in the portable programming unit through the audio speaker of the speaker unit in response to an operator control prior to the downloading of the announcement into the speaker unit.

8. A system for providing a programmable announcement capability to a newsrack, comprising:

a speaker unit, including:

means for mounting the unit to the newsrack, a trigger switch for sensing a potential customer stimulus, an input to receive an announcement in electronic form, an audio speaker, and a voice circuit in electrical communication with the trigger switch, the input, and the audio speaker, the voice circuit being operative to perform the following functions;

receive and store the announcement in electronic form, retrieve the stored announcement upon activation of the trigger switch, and deliver an electrical signal representative of the announcement to the audio speaker so that the announcement may be heard by the customer; and a portable programming unit, including:

means for storing one or more announcements in electronic form, an output adapted for electrical coupling to the input of the speaker unit, and an operator control, whereby an announcement stored within the portable programming unit may be downloaded into the speaker unit upon activation of the operator control.

9. The system of claim 8, wherein the newsrack includes an access panel, and wherein the trigger switch is mechanically coupled to the access panel.

10. The system of claim 8, wherein the speaker unit further includes:

sensing means for detecting when a person is physically proximate to the newsrack, and wherein the trigger switch delivers an activation signal to the speaker unit in response thereto.

11. The system of claim 8, wherein the speaker unit is further operative to:

deliver an electrical signal representative of the announcement to the audio speaker on an occasional basis without the trigger switch being activated.

12. The system of claim 8, wherein the portable programming unit further includes:

a speaker; and electrical circuitry for audibly reviewing a stored announcement in response to an operator control prior to the downloading of the announcement into the speaker unit.

13. The system of claim 8, further including:

electrical circuitry associated with the portable programming unit and speaker unit for audibly reviewing an announcement stored in the portable programming unit through the audio speaker of the speaker unit in response to an operator control prior to the downloading of the announcement into the speaker unit.

* * * * *

UNITED STATES PATENT AND TRADEMARK OFFICE

CERTIFICATE OF CORRECTION

PATENT NO. : 5,671,331
DATED : September 23, 1997
INVENTOR(S) : Croley

It is certified that error appears in the above-indentified patent and that said Letters Patent is hereby corrected as shown below:

Column 1, line 16: Replace "comers" with --corners--.

Column 1, line 24: Replace "comers" with --corners--.

Column 1, line 45: Replace "rocks" with --racks--.

Signed and Sealed this

Seventeenth Day of February, 1998

*Attest:*

Bruce Lehman

BRUCE LEHMAN

*Attesting Officer*

*Commissioner of Patents and Trademarks*